United States Patent [19]

Stephenson

[11] Patent Number: 4,521,928

[45] Date of Patent: Jun. 11, 1985

[54] WATERBED FRAME CONSTRUCTION

[76] Inventor: Michael C. Stephenson, 2520 44th St., Lubbock, Tex. 79413

[21] Appl. No.: 504,384

[22] Filed: Jun. 15, 1983

[51] Int. Cl.[3] ..... A47C 19/00; A47C 27/08

[52] U.S. Cl. ..... 5/400; 5/451; 5/460

[58] Field of Search ..... 5/451, 460, 400, 401, 5/474

[56] References Cited

U.S. PATENT DOCUMENTS

| | | | |
|---|---|---|---|
| 3,736,605 | 6/1973 | Klein, Jr. | 5/451 |
| 4,057,862 | 4/1977 | La Bianco | 5/460 |
| 4,062,077 | 12/1977 | Autrey et al. | 5/451 |
| 4,073,019 | 2/1978 | Fraser | 5/451 |
| 4,077,074 | 3/1978 | Fogel | 5/451 |
| 4,103,375 | 8/1978 | Santo | 5/451 |
| 4,145,781 | 3/1979 | Autrey et al. | 5/451 |
| 4,160,296 | 7/1979 | Fogel | 5/400 |
| 4,187,567 | 2/1980 | Crowther | 5/451 |
| 4,197,602 | 4/1980 | Johenning | 5/451 |
| 4,354,289 | 10/1982 | Richards | 5/451 |
| 4,389,741 | 6/1983 | Larson | 5/460 |

OTHER PUBLICATIONS

"Waterworth 131"-A Trade Brochure Published in 1981 by Waterworth Co. in Lawndale, Calif., 90260.

*Primary Examiner*—Alexander Grosz

*Attorney, Agent, or Firm*—Hubbard, Thurman, Turner & Tucker

[57] ABSTRACT

A waterbed frame construction comprising a perimeter frame made up of longitudinal and transverse channel shaped frame members which are provided with foam pad cushions along the upper side edges of the frame and the outwardly facing sides of the frame. A slot is formed in the outer peripheral vertical side of the frame to receive a tuck of an article of bedclothing to retain the bedclothing on the bed and covering the sleeping surface of the waterfilled bladder. The frame includes a substructure for supporting the bladder comprising spaced apart longitudinal beam members and a support deck. The frame may be disassembled for transport, is of superior strength due to the channel shaped perimeter beam members, and is adapted to accommodate and retain standard size sheets and blankets. The frame may be suitably supported on a standard bed sub-frame.

14 Claims, 5 Drawing Figures

WATERBED FRAME CONSTRUCTION

BACKGROUND OF THE INVENTION

1. Field of the Invention

The present invention pertains to a waterbed frame construction comprising a peripheral frame for supporting and containing a waterbed mattress or bladder wherein the frame is cushioned around the upper and side edges, is of lightweight rigid construction and is provided with a slot along the side edges for receiving a tuck or the peripheral edges of bedclothing.

2. Background

The development of so called waterbeds wherein the mattress comprises a waterfilled bladder of a plastic or similar flexible material has presented certain problems in the art of bed construction. Conventional waterbed construction comprises a perimeter frame of generally rectangular configuration and constructed of relatively heavy and stiff structural members, usually made of wood, and of sufficient strength to contain the waterfilled mattress to maintain the desired shape. The strength requirements of the frame have usually been met by providing a perimeter frame of conventional heavy wooden planks supported on a deck. The deck member is mounted on a substructure also comprising a perimeter frame enclosing an egg crate type cross frame structure to support the upper frame, deck, and the waterfilled mattress. The bed structure is usually also provided with a flexible plastic liner disposed around the inner side of the upper perimeter frame to contain the mattress and any water which might leak out of the mattress as a result of a puncture.

The conventional frame construction described above has several disadvantages. The massive upper perimeter frame is heavy in itself, is uncomfortable when sitting on the edge of the bed or when contacted by a person getting in or out of bed or during movement on the bed when sleeping. Moreover, conventional waterbed frame construction has presented problems in the use of standard sizes and configurations of bedclothing such as sheets, mattress pads and blankets. One problem with the use of conventional bedclothing is in regard to sheets, for example, which cannot be easily retained in place on the mattress. If the edges of the sheets are tucked between the mattress and the safety liner they do not remain in place due to the flexibility and deformability of the mattress and the low coefficient of friction of the plastic material used for the mattress and the liner. Moreover, conventional waterbed frames do not provide any means for securing the edges of bedclothing if it is desired to cover the upper sides of the frame as well as the mattress. In other words, since the bed structure has been modified to provide support for the flexible waterbed mattress the use of standard bedclothing has been made difficult and inconvenient, and the appearance of the bed has been relatively unattractive.

Several modifications of the above-described conventional waterbed frame structure have been attempted. For example, one type of waterbed frame comprises a peripheral rigid framework which contains the waterbed mattress or bladder and over which a cushioned shell or cover is disposed to increase the comfort of sitting on the bed and to give the bed the appearance of a conventional inner spring mattress and box spring arrangement. However, one disadvantage of the aforementioned type of waterbed construction is that the cushion extending over the sleeping surface of the mattress reduces the comfort factor and therapeutic value originally intended to be provided by the waterfilled bladder type mattress. Another disadvantage of the cap or shell type frame construction is that the sleeping area covered by the waterfilled bladder is reduced, or alternatively, the frame must be so large that special oversized bedclothing must be provided to cover the shell or cap. The rather bulky and heavy shell or cap must be removed to gain access to the waterfilled bladder or mattress for inspection and/or servicing as required. Moreover, the aforedescribed shell or cap type structures are relatively complicated and expensive and still require the use of a rigid perimeter frame structure for containment of the mattress. The cap or shell type waterbed frame structures are also difficult or impossible to adequately disassemble for transport purposes.

Accordingly, prior art efforts to overcome the disadvantages of waterbed construction have not been entirely successful and have not alleviated certain problems associated with waterbed structures. However, with the development of the present invention several desired features of waterbed construction are provided which have been heretofore unrealized.

SUMMARY OF THE INVENTION

The present invention provides an improved waterbed frame construction which is adapted to support a flexible waterfilled bladder or mattress wherein maximum comfort is obtained when sleeping on the bed as well as when sitting on the edge of the bed and getting into and out of the bed. The present invention also provides for the use and containment of conventional bedclothing, and provides a pleasing appearance similar to that of a conventional mattress and support spring structure. The present invention further provides suitable support for a waterfilled mattress with a relatively lightweight structure adapted to be disassembled into a compact package for transport and which is easily assembled for use.

In accordance with one aspect of the present invention there is provided a waterbed frame formed by interconnected perimeter members making up a generally rectangular boxlike structure which is relatively lightweight but adapted to provide the lateral strength necessary to contain and prevent deformation of the waterfilled bladder type mattress. The frame structure does not substantially increase the area occupied by the frame and thereby permits the use of conventional or standard bedclothing for covering the bed.

In accordance with another aspect of the present invention there is provided a waterbed frame construction which includes cushion means around the upper peripheral edge of the frame as well as the outer side edges of the frame to provide maximum comfort for the user when sitting on the edge of the bed or when getting into and out of the bed. The frame construction also provides for substantially direct contact of the waterbed mattress sleeping surface by the bed occupant to provide for maximum comfort and therapeutic value gained from the use of the waterbed.

In accordance with still a further aspect of the present invention there is provided a waterbed frame construction including means along the outer vertical side of the frame for receiving a tuck or the peripheral edge of bedclothing to suitably retain items such as sheets and blankets in place and covering the mattress sleeping surface. The construction of the improved waterbed frame permits the use of standard size sheets as well as form fitted sheets which may be placed on the bed to give the appearance of a conventional mattress and supporting foundation and to assure that the bedclothing remains in place during use of the bed. The tuck providing means is preferably characterized by a peripheral slot formed between opposed cushion members extending along the outer sides of the peripheral frame structure.

The waterbed frame construction of the present invention is still further characterized by a modular frame construction including opposed longitudinal perimeter frame members and opposed transverse perimeter frame members which may be joined together by connecting brackets to form a rectangular box frame. The perimeter frame members are of lightweight channel type construction which provides substantial rigidity in the frame but which does not increase the dimensions of the frame. A transverse foundation plate or deck is supported in an improved manner by longitudinal risers so that the waterfilled bladder or mattress is adequately supported in a position wherein the top horizontal sleeping surface of the bladder is at least substantially even or coplanar with the top peripheral edge of the frame. The frame is also adapted to mount on a conventional steel bed sub-frame or the like.

The inventive frame construction described herein provides several advantages in the art of waterbeds. The frame structure is relatively lightweight, easily adapted to modular construction and may be shipped in a relatively compact knocked down or disassembled condition. The frame does not reduce or interfere with the sleeping surface area of the mattress and permits the use of standard sizes of bedclothing used for conventional beds. The frame is constructed to provide maximum sitting comfort and also to minimize the discomfort caused by engagement of the frame by a person getting into or out of bed or when sleeping on the waterfilled mattress. The waterfilled mattress or bladder is easily accessible for inspection and servicing and there is no tendency for trapping air around the mattress resulting in condensation as with certain types of capped waterbed frame and mattress structures.

The frame has the appearance of a conventional bed structure and advantageously provides means for tucking and retaining the edges of bedclothing in a unique manner. The frame structure permits the use of a relatively deep straight sidewall waterfilled mattress or bladder for maximum sleeping comfort and therapeutic value. These and several other advantages will be appreciated by those skilled in the art upon reading the detailed description which follows in conjunction with the drawings.

DESCRIPTION OF THE PREFERRED EMBODIMENT

Figure 2:
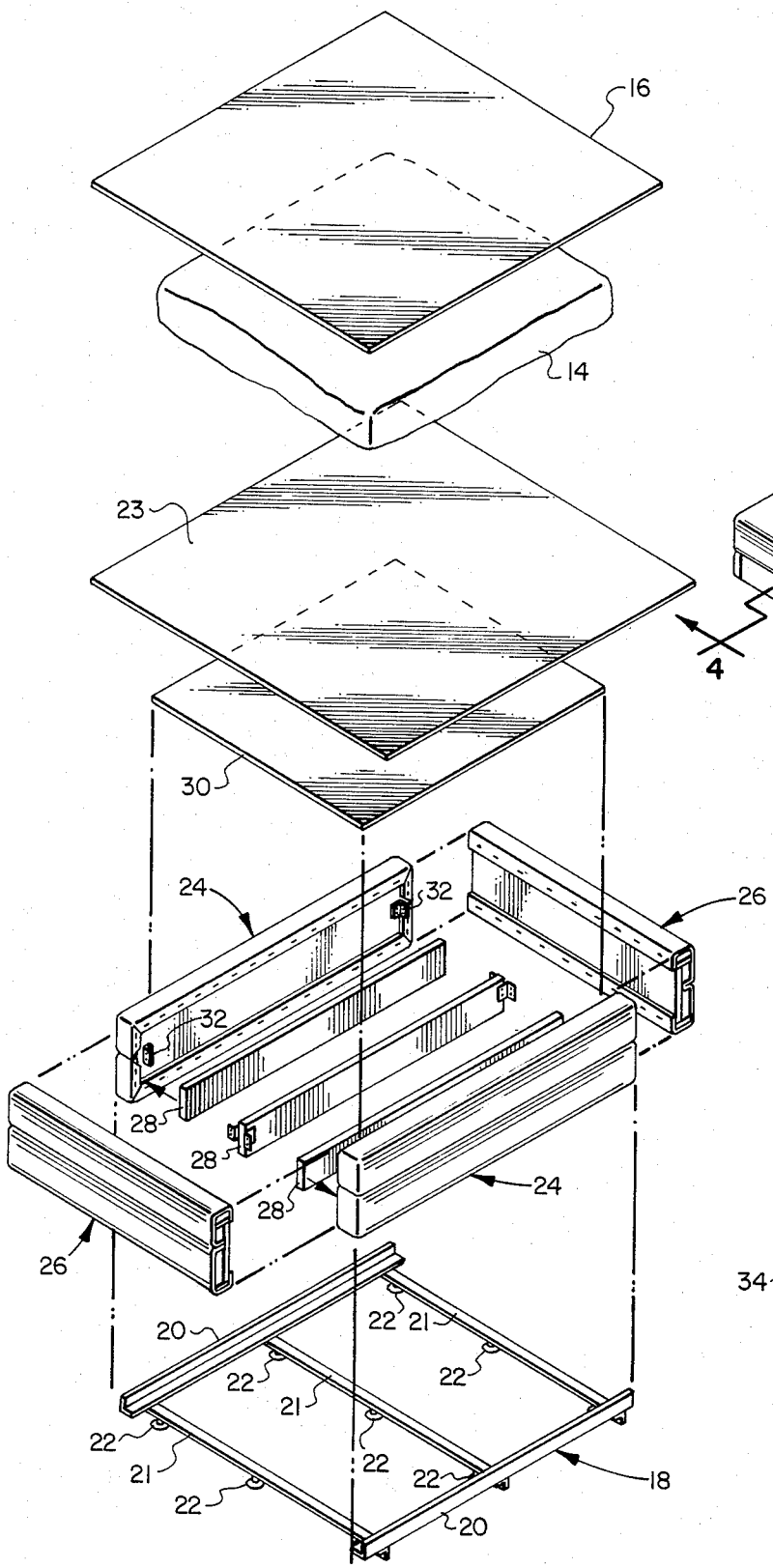
FIG. 2 is an exploded perspective view of the waterbed illustrated in FIG. 1.

In the description which follows like parts are marked throughout the specification and drawings with the same reference numerals, respectively. The drawings are not necessarily to scale and certain features of the invention may be shown somewhat exaggerated in scale or in schematic form in the interest of clarity and conciseness.

Figure 1:
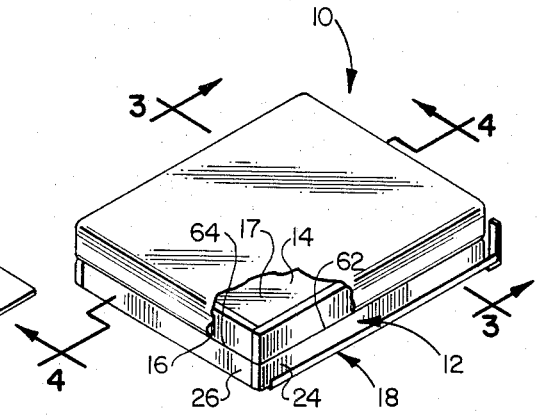
FIG. 1 is a perspective view of a waterbed including the improved frame construction of the present invention.

Referring to FIG. 1, there is illustrated a waterbed, generally designated by the numeral 10, which is provided with a frame construction in accordance with the present invention and generally designated by the numeral 12. The waterbed 10 includes a waterfilled bladder or mattress 14 which is supported by the frame 12 in an improved manner as will be described herein. As will be recognized by those skilled in the art, the waterbed 10 has the outward appearance of a conventional bed structure and is adapted to be covered with conventional bed clothes such as a sheet 16 overlying the top horizontal surface 17 of the mattress 14 and also overlying the upper sides of the frame 12 in a manner resembling the conventional arrangement of an inner spring mattress and box spring foundation. Moreover, the frame 12 is also adapted to mount on a conventional structural steel or aluminum bed sub-frame 18. As shown in FIG. 2, the sub-frame 18 comprises spaced apart longitudinally extending angle shaped rails 20 and cross brace members 21. The sub-frame 18 is also adapted to include conventional feet 22 which may be characterized as glides or swiveling casters of sufficient number to support the sub-frame 18 and the structure supported thereby so that the bed 10 may be moved about in the same manner as a conventional inner spring mattress-box spring foundation type bed.

Referring further to FIG. 2, in particular, the waterfilled mattress or bladder 14 is illustrated as being of a substantially rectangular box shaped configuration of conventional design and formed of a flexible plastic material. The mattress 14 is in itself not a part of the present invention and may be provided in various sizes in accordance with the particular size of the bed frame 12. One suitable type of mattress or bladder 14 is available commercially from American Thermo Seal as their Model Waterway for a standard or so called full size bed. It will be understood that the bed frame construction of the present invention may, of course, be adapted for use in conjunction with virtually all standard sizes of beds. FIG. 2 also illustrates a plastic sheet type safety liner, generally designated by the numeral 23, and shown in an unformed or unfolded condition. The liner 23 is adapted to be used in a conventional manner in conjunction with the mattress 14 and the frame 12 to contain water which might leak out of the bladder. The arrangement of the liner 23 will be further described in conjunction with FIGS. 3 and 4 of the drawings.

Referring still further to FIG. 2, the frame 12 comprises a generally rectangular perimeter frame structure made up of opposed longitudinal side members 24 and end members 26, respectively. The side members 24 are each adapted to be secured to longitudinal beam members 28 extending along the lower inside edges of the members 24, respectively. An intermediate beam member 28 is adapted to be connected at its opposite ends to the end members 26, respectively, by suitable brackets when the frame 12 is in the assembled condition. The beam members 28 are arranged such that their top longitudinal edges are coplanar and are adapted to support a deck member 30 for supporting the mattress 14. The deck 30 may be suitably secured to the beam or riser members 28 by removable threaded fasteners or the like, not shown.

Figure 3:
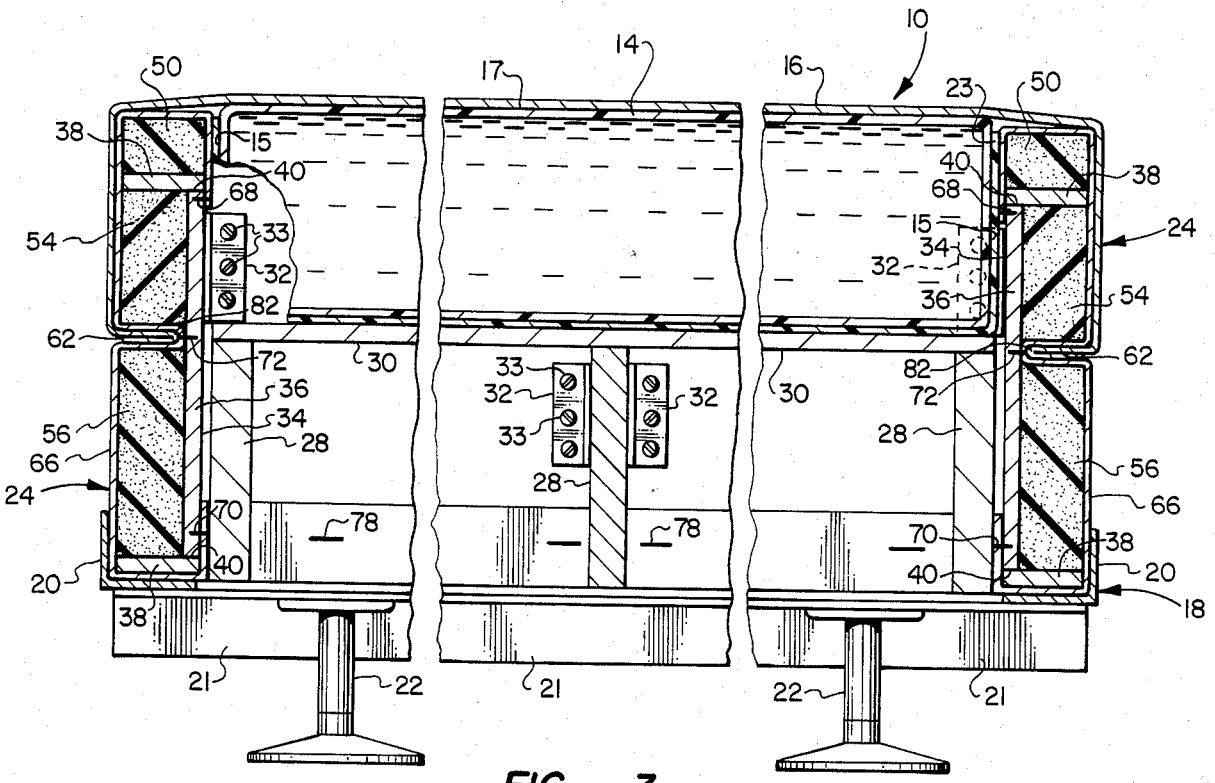
FIG. 3 is a section view taken along the line 3—3 of FIG. 1.

The transverse end frame members 26 are adapted to be secured to the longitudinal frame members 24 at their respective adjacent ends by L shaped brackets 32, two shown in FIG. 2, and which are adapted to secure the adjacent corners of the frame members to each other by suitable threaded fasteners 33, as shown by way of example in FIG. 3. Accordingly, the frame 12 may be disassembled for ease of transport wherein the deck 30 is the member taking up the greatest amount of area. Conceivably, the deck 30 may be formed of a series of planks or strips of no greater width than the width or height of the frame members 24 and 26 so that the frame 12 may be provided as a packaged unit comprising the members 24, 26, 28 and 30 which will fit in an envelope wherein the dimensions of the members 24 are the maximum outline dimensions of the package.

Accordingly, a bed such as the bed 10 may be disassembled for transport and assembled at the sight of use of the bed itself. The aforedescribed members making up the frame 12 may, of course, be permanently assembled to each other. Moreover, it will be appreciated from the further description herein that certain features of the frame members 24 and 26 may be utilized in a waterbed perimeter frame having different mattress support structure than that described herein. However, the overall combination of structure of the bed frame 12 is believed to be superior to waterbed frames heretofore known.

Referring now to FIG. 3, in particular, the bed 10 is shown in its assembled condition and the configuration of the frame members 24 is shown in detail. The frame members 24 and 26 are of unique construction and of superior strength for their overall dimensions and weight. The frame members 24 are each preferably formed of an elongated channel shaped member 34 including a web 36 and opposed flanges 38. The web 36 and the flanges 38 may be formed as separate members joined together along an interface 40 or the member 34 may be formed as an integral part. Laminated wood, pressed particle board, cast or extruded metal or cast or formed plastic may be used to manufacture the member 34.

The channel shaped section of the member 34 provides superior strength to resist bending or bowing horizontally outwardly away from the mattress 14 as a result of forces exerted on the members 34 by the bladder sidewalls 15 due to the relatively significant weight of the water contained within the bladder as well as the weight of bed occupants lying on the sleeping surface 17. It has been determined that suitable strength of the member 34 may be provided using plywood or pressed particle board of nominal 0.50 inches thickness wherein the width of the web 36 is a nominal 11.50 inches and the width of the flanges 38 is a nominal 2.0 inches. These overall dimensions permit the use of standard 1.0 inch by 5.25 inch wood beams for the members 28. The deck 30 may be suitably formed of 0.50 inch thick plywood, for example. These dimensions advantageously permit use of a mattress 14 which is approximately 9 inches deep. With the abovementioned dimensions only the length of the members 24, 26 and 28 need by varied to provide a frame for various standard bed sizes.

Figure 4:
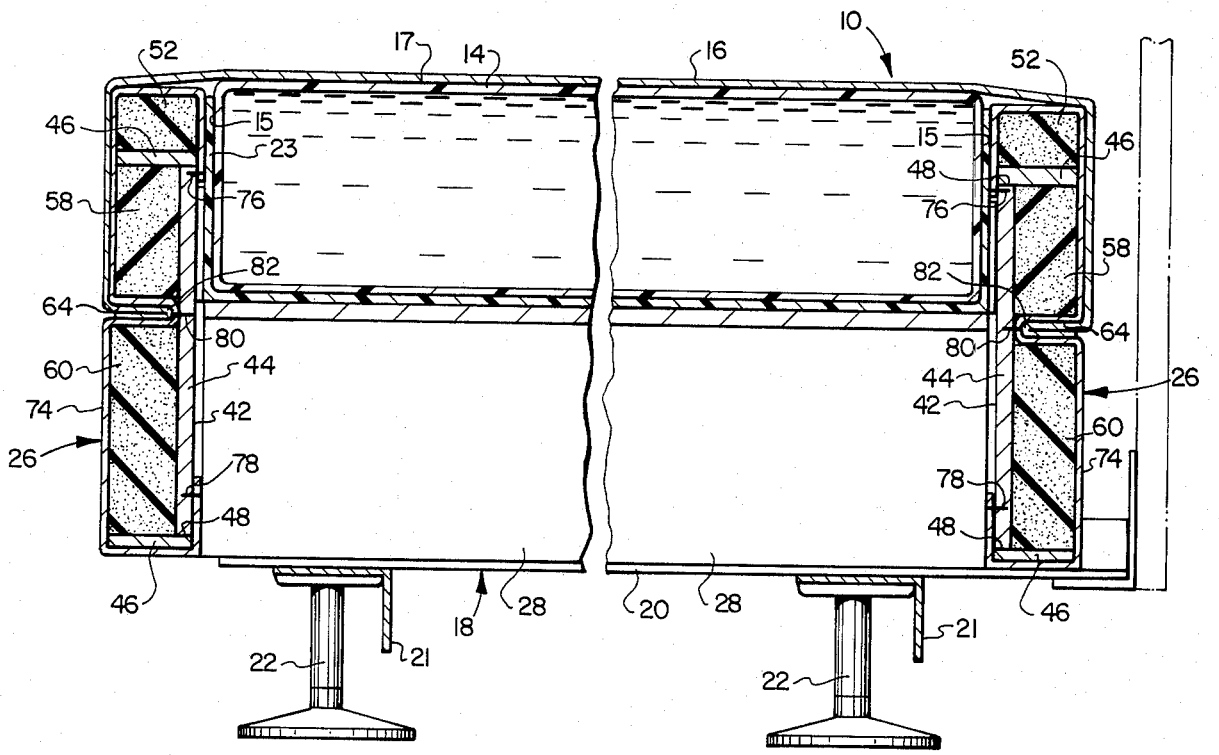
FIG. 4 is a section view taken along the line 4—4 of FIG. 1.

Referring to FIG. 4, the frame members 26 are of substantially identical construction as the members 24, the only difference being in the length of the respective frame members. The frame members 26 are provided with elongated channel section beam members 42 having a web 44 and opposed flanges 46. The beam members 42 may be formed as integral structures of the same material as the beam members 34 or the web 44 may be formed separate from the flanges 46 and joined to the flanges at the interfaces 48 as indicated in FIG. 4.

Referring further to FIG. 3 and FIG. 4, the frame 12 is also adapted to provide superior comfort to the bed user and a pleasing appearance by the provision of elongated cushions comprising part of the members 24 and 26 and characterized by foam pads 50 and 52 suitably disposed on the upwardly facing surfaces of the flanges 38 and 46. The pads 50 and 52 may be formed of 3.0 lb. per sq. ft. density polyurethane foam having an indent load deflection number of 100, or a suitable cushion material which will retain its shape but which will also be suitably resiliently deflectable to provide comfort to a person sitting on the edge of the bed 10 or inadvertently contacting the edge when sleeping on the mattress 14. The outwardly facing sides of the members 24 and 26 are also provided with cushion means comprising elongated foam pads 54 and 56 for the members 24 and pads 58 and 60 for the members 26, as indicated. The pads 54–56 and 58–60 are dimensioned to substantially fill the spaces between the opposed flanges of the respective beam members 34 and 42 and are adapted to be placed directly adjacent to each other. However, the provision of the separate pad members 54 and 56 as well as the pad members 58 and 60 provides elongated horizontal slots 62 and 64 which are coplanar with each other. The cushion means provided by the pads 54–56 and 58–60 could also be a continuous piece in each case with a suitable slot or recess formed therein. A fabric cover for the members 24 is designated by the numeral 66 and is characterized by a suitable woven cloth such as damask secured along opposed longitudinal edges to the inner side edges of the beam member 34, for example, by suitable fasteners such as staples 68 and along the lower edges of the members 24 by staples 70. The cover 66 is also secured to the outer vertical surface of the web 36 at 72 also by stapling or other suitable fastening means to define the aforementioned slot 62 between the pads 54 and 56. When dimensioning the pads 54 and 56, essentially zero clearance is originally provided between the pads in their relaxed state. However, as the members 24 are assembled by stretching the cover 66 over the pads 54 and 56 and securing the cover at 72, the pads 54 and 56 are suitably deformed to define the slot 62 but the resiliency of the pads urges them toward each other to reduce the width of the slot 62 to essentially nil.

Figure 5:
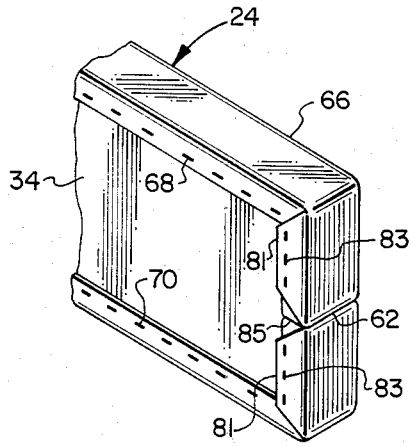
FIG. 5 is a detail view of a corner of one of the frame side members.

The members 26 are, of course, each configured in a similar manner by the provision of a cover 74 which is attached along the upper and lower inner sides of the beam member 42 at 76 and 78 by staples, as shown, or other suitable fastenings. The cover 74 is also secured to the outwardly facing side of the web 44 at 80 to define the slot 64 in the same manner as described above for the members 24. The covers 66 and 74 are preferably folded over and fastened to the respective beam members 34 and 42 at their respective opposed longitudinal ends. FIG. 5 illustrates the end of one of the members 24 wherein the cover 66 is folded in two places at 81 and suitably fastened by staples 83. The beam members 24 are preferably formed with a short longitudinal cut or slot at 85, FIG. 5, and aligned with the slot 62 at its opposite ends whereby a slot of continuous uniform depth is provided around the periphery of the frame when the members 24 and 26 are assembled. The pads 50, 54 and 56 may also be extended just beyond the ends of the members 34 and folded to cover the exposed beam ends to provide cushioning therefor.

When the bed frame 12 is assembled the continuous slot formed around the outer side of the frame is adapted to receive a tuck 82 of an article of bedclothing such as the sheet 16 as shown in FIGS. 3 and 4. Accordingly, with the construction of the bed frame 12 in accordance with the above description there is provided means for receiving a tuck or the edges of bedclothing, such as the bottom sheet 16, to firmly secure the sheet on the bed in a much improved manner for waterbed construction. In this way, the sheet is not required to be held in place by the bladder or mattress 14. The cushion pads along the outer sides of the members 24 and 26 may be further deformed or compressed to widen the slot 62–64 to receive the edges of a top sheet and one or more blankets also. Furthermore, thanks to the construction of the members 24 and 26, the strength of the members is relatively great due to the provision of the beam members 34 and 42, respectively, which resist horizontal lateral outward deflection but which are not required to be of substantial weight or thickness relative to their strength.

The provision of the foam cushion pad members 50 and 52 along the top edges of the respective frame members 34 and 42 as well as the pad members along the outer side edges of the frame members also greatly enhances the comfort of the bed user and minimizes the chance of injury resulting from hitting the outer side or the top edge of the frame when getting into or out of bed. The configuration of the frame members 24 and 26 also results in a bed frame 12 which has the appearance of a conventional inner spring mattress and box spring bed configuration, particularly when the bed is covered with at least a bottom sheet such as the sheet 16. The relatively narrow width of the frame 12 also permits the use of standard sizes of articles of bedclothing for waterbeds such that a purchaser of a waterbed 10 would not be required to purchase entirely new sets of bedclothing if they formerly had a conventional bed of the same size designation.

The frame 12 may be placed in use by assembling the perimeter members 24 and 26 to each other using the brackets 32 at adjacent corners of the frame members. The beams 28 may also be secured to the members 24 in the proper positions indicated in FIGS. 2 and 3 by suitable fasteners, not shown, and the center beam 28 may be secured to the members 26 at its opposite ends by brackets 32, for example, as shown in FIG. 3. The frame 12 may then be mounted on sub-frame 18 and the deck 30 placed in position over the tops of the beams 28.

After assembly of the frame 12, the liner 23 may be placed in the position shown in FIGS. 3 and 4 and secured to the inner sides of the members 24 and 26 at the upper edges of the liner such as by stapling or the like. The mattress or bladder 14 may then be installed within the space defined by the liner 23 and suitably filled with water in readiness for use. Preferably, a standard size lower sheet 16 is then installed over the top surface 17 of the mattress 14 and with its edges folded into the slots 62–64 around the perimeter of the frame 12 to form the truck 82. Accordingly, the bed 10 may be made up with its bedclothing in a manner substantially identical to the making up of a conventional bed having a mattress supported by a foundation structure of conventional design. The frame 12, of course, may be easily disassembled if it is necessary or desirable to move the bed, although, the relatively lightweight construction of the frame permits use of a conventional bed sub-frame 18 wherein the bed may be moved about in a room without disassembly.

The relatively narrow width of the frame 12 provided by the perimeter members 24 and 26 maximizes the sleeping area and provides for the use of standard commercially available waterbed mattresses or bladders. Moreover, the overall arrangement of the bed permits the user to sleep essentially directly on the upper surface of the mattress 14 except, of course, for intervening conventional bedclothing such as the sheet 16.

Although a preferred embodiment of the present invention has been described in detail herein those skilled in the art of waterbed construction will recognize that certain substitutions and modifications may be made without departing from the scope and spirit of the invention recited in the appended claims.

What I claim is:

1. A frame for supporting a waterbed mattress comprising:

a substantially rectangular perimeter frame portion comprising opposed parallel side frame members and opposed parallel end frame members forming an enclosure for containing a flexible waterfilled bladder comprising said mattress to prevent lateral bulging of said mattress, and means forming a support deck for supporting said mattress, said side and end members being formed by elongated shallow channel section members having a vertically extending web and opposed generally horizontally extending flanges, the lower one of said flanges being adapted for supporting said frame on a bed sub-frame and the upper one said flanges forming a perimeter edge of said frame adjacent the sleeping surfaces of said mattress, and resilient cushion pad means extending along the outer sides of the webs of at least said side members and one of said end members, said pad means being formed to include a substantially horizontally extending slot along said side members and said at least one end member for receiving the peripheral edge of an article of bedclothing to retain said article covering said mattress.

2. The frame set forth in claim 1 wherein:

said channel members include means forming resilient cushion pad means disposed along an upward facing surface of said upper flange.

3. The frame set forth in claim 2 including:

a fabric cover over said channel members extending from an inner side of said web over said pad means along said upward facing surface of said upper flange and over said pad means between said flanges.

4. A bed frame adapted for enclosing a flexible mattress comprising:

a substantially rectangular perimeter frame portion comprising opposed parallel rigid side frame members and opposed parallel rigid end frame members forming an enclosure for containing said mattress, said frame members each comprising a channel shaped member having opposed parallel flanges and an interconnecting web portion, and resilient cushion pad means extending along the outer sides of said web portions, said pad means being formed to include a continuous slot extending substantially horizontally along said outer side of said frame members, said pad means being elastically deformable to vary the width of said slot for receiving the peripheral edge of an article of bedclothing to retain said article covering said mattress.

5. A bed frame construction particularly adapted for supporting a waterfilled bladder type mattress, said frame construction being adapted to be supported on a subframe comprising two spaced apart frame rails, said frame construction including:

opposed parallel longitudinal side frame members;

opposed parallel transverse end frame members;

means for securing said side and end frame members to each other to form a generally rectangular open top enclosure for containing said mattress against horizontal bulging;

means for supporting said mattress comprising at least two elongated beam members adapted to be secured to the respective inner sides of one of said opposed side and end frame members, respectively, for supporting therebetween a generally horizontal deck member for supporting said mattress; and said side and end frame members each comprised of channel sections comprised of a channel shaped member having opposed flanges and an interconnecting web portion, said channel sections covered on their top and outer side surfaces by resilient cushion means, said resilient cushion means being formed to have a generally horizontally extending slot therein along said frame members and at least one of said end frame members for receiving a tuck of an article of bedclothing for retaining said article covering a sleeping surface of said mattress.

6. The bed frame construction set forth in claim 5 including:

at least one elongated beam member extending parallel to and aligned with said two beam members and secured to respective ones of the other of said side and end frame members at its opposite ends, respectively, and supportive of said deck.

7. The bed frame construction set forth in claim 5 wherein:

said side and end frame members include means along the outer sides thereof for receiving a tuck of an article of bedclothing for retaining said article covering said mattress across the top of said enclosure.

8. In a waterbed construction, a perimeter frame including a substantially rigid frame member comprising elongated channel shaped beam means extending around the periphery of a waterfilled bladder type mattress, said beam means including a web extending vertically between substantially horizontal outwardly projecting spaced apart flanges, resilient cushion pad means extending along the outer side of said beam means between said flanges, said pad means being formed to include a slot extending substantially horizontally along said outer side of said frame member and comprising means for receiving a tuck of an article of bedclothing for retaining said article covering a sleeping surface of said mattress.

9. The waterbed construction set forth in claim 8 wherein:

said frame member comprises an upward facing perimeter surface around the edge of said mattress, said surface including cushion pad means extending at least partially therealong.

10. The waterbed construction set forth in claim 9 wherein:

said frame includes a fabric cover disposed over said cushion pads on said frame member and extending into said slot.

11. The waterbed construction set forth in claim 12 wherein:

said frame member comprises a substantially rectangular box shaped structure enclosing the sides of said mattress and comprising elongated parallel side members and opposed parallel end members joined together at their respective adjacent ends to form said beam means, said slot extending along the outer sides of said side and end members to form a continuous slot around the periphery of said frame.

12. The waterbed construction set forth in claim 11 wherein:

said side and end members are joined by corner bracket means at said respective adjacent ends.

13. The waterbed construction set forth in claim 11 wherein:

said frame comprises mattress support means including a plurality of elongated beams extending parallel to the lower sides of one of said side members and end members, means forming a mattress support deck supported on said beams and adapted to support a bottom side of said mattress.

14. The waterbed construction set forth in claim 8 wherein:

said cushion pad means is elastically deformable to vary the width of said slot for receiving said tuck and for gripping the portion of said article forming said tuck.

* * * * *